US012492050B2

(12) United States Patent
Krautkrämer

(10) Patent No.: US 12,492,050 B2
(45) Date of Patent: Dec. 9, 2025

(54) CLOSURE DEVICE

(71) Applicant: BERICAP Holding GmbH, Budenheim (DE)

(72) Inventor: Christian Krautkrämer, Eltville (DE)

(73) Assignee: BERICAP HOLDING GMBH, Budenheim (DE)

( * ) Notice: Subject to any disclaimer, the term of this patent is extended or adjusted under 35 U.S.C. 154(b) by 273 days.

(21) Appl. No.: 18/550,588

(22) PCT Filed: Mar. 4, 2022

(86) PCT No.: PCT/EP2022/055593
§ 371 (c)(1),
(2) Date: Sep. 14, 2023

(87) PCT Pub. No.: WO2022/194577
PCT Pub. Date: Sep. 22, 2022

(65) Prior Publication Data

US 2024/0150092 A1 May 9, 2024

(30) Foreign Application Priority Data

Mar. 16, 2021 (DE) ..... 10 2021 106 367.1

(51) Int. Cl.
*B65D 51/22* (2006.01)
*B65D 5/74* (2006.01)
(Continued)

(52) U.S. Cl.
CPC ..... *B65D 51/222* (2013.01); *B65D 5/748* (2013.01); *B65D 41/34* (2013.01); *B65D 55/026* (2013.01);
(Continued)

(58) Field of Classification Search
CPC ..... B65D 51/222; B65D 5/748; B65D 41/34; B65D 55/026; B65D 55/16;
(Continued)

(56) References Cited

U.S. PATENT DOCUMENTS 9,776,779 B2 * 10/2017 Campbell ..... B65D 41/34
2013/0043260 A1 2/2013 Barron
(Continued)

FOREIGN PATENT DOCUMENTS

CA 3024024 A1 * 6/2019 ..... B65D 53/02
DE 102009045124 A1 3/2011
(Continued)

OTHER PUBLICATIONS

International Preliminary Report on Patentability issued Sep. 12, 2023, in corresponding International Application No. PCT/EP2022/055593, 7 pages.
(Continued)

*Primary Examiner* — Bob Zadeh
(74) *Attorney, Agent, or Firm* — Maier & Maier, PLC

(57) ABSTRACT

A closure device for closing a container, the closure device including a basic member, the basic member having a channel extending along a closure axis and having an inlet opening and a pouring opening, the closure device including a closure cap, the closure cap and the basic member being formed and arranged relative to each other in such a manner that the closure cap closes the pour-ing opening in a closed state of the closure device and releases it in an open state of the closure device. The closure cap is mounted on the basic member in the closed state of the closure device so as to be rotatable about the closure axis relative to the basic member, so that the closure cap is rotatable in an opening direction relative to the basic member, to bring the closure device into the open state.

16 Claims, 13 Drawing Sheets

(51) Int. Cl.
*B65D 41/34* (2006.01)
*B65D 55/02* (2006.01)
*B65D 55/16* (2006.01)

(52) U.S. Cl.
CPC ..... *B65D 55/16* (2013.01); *B65D 2203/12* (2013.01); *B65D 2251/0015* (2013.01); *B65D 2251/0096* (2013.01); *B65D 2401/30* (2020.05)

(58) Field of Classification Search
CPC ..... B65D 2203/12; B65D 2251/0015; B65D 2251/0096; B65D 2401/30; B65D 2251/0093
See application file for complete search history.

(56) References Cited

U.S. PATENT DOCUMENTS

| | | | | |
|---|---|---|---|---|
| 2019/0185219 | A1* | 6/2019 | Wang | B65D 55/16 |
| 2022/0144500 | A1* | 5/2022 | Gauthey | B65D 41/3447 |
| 2024/0150092 | A1* | 5/2024 | Krautkrämer | B65D 41/34 |

FOREIGN PATENT DOCUMENTS

| | | | | |
|---|---|---|---|---|
| DE | 102010040825 | A1 | 3/2012 | |
| DE | 202019106993 | U1 | 1/2020 | |
| DE | 202020100758 | U1 * | 3/2020 | B65D 55/16 |
| EP | 1623931 | A1 | 8/2006 | |
| EP | 1902965 | A1 | 3/2008 | |
| EP | 3715271 | A1 * | 9/2020 | B65D 5/748 |
| EP | 3715273 | A1 | 9/2020 | |
| EP | 3805126 | A1 | 4/2021 | |
| EP | 3868680 | A1 | 8/2021 | |
| WO | 2020206215 | A1 | 10/2020 | |
| WO | 2020251984 | A1 | 12/2020 | |
| WO | WO-2021028167 | A1 * | 2/2021 | B26D 3/08 |

OTHER PUBLICATIONS

International Preliminary Report on Patentability issued Sep. 28, 2023, in corresponding International Application No. PCT/EP2022/055593, 1 page.
International Search Report issued Jun. 17, 2022, in corresponding International Application No. PCT/EP2022/055593, 15 pages.
German Search Report issued Jul. 21, 2021, in German Application No. 10 2021 106 367.1, 10 pages.
Office Action issued on Jul. 15, 2025, in corresponding European Application No. 22710391.8, 18 pages.

* cited by examiner

B-B

CLOSURE DEVICE

FIELD

The present invention relates to a closure device for closing a container, in particular a beverage carton.

BACKGROUND

Such a closure device comprises a basic member, the basic member having a channel extending along a closure axis and having an inlet opening and a pouring opening, the closure device also comprising a closure cap, wherein the closure cap and the basic member are formed and arranged relative to each other in such a way that the closure cap closes the pouring opening in a closed state of the closure device and releases it in an open state of the closure device, wherein the closure cap in the closed state of the closure device is rotatably mounted on the basic member about the closure axis relative to the basic member so that the closure cap is rotatable in an opening rotational direction relative to the basic member to bring the closure device into the open state, wherein the closure device comprises a cutting device with a cutting element arranged at least partially within the channel and wherein the closure cap comprises a driving device, wherein the driving device and the cutting device are designed and arranged in such a way that a first rotation of the closure cap in the opening rotation direction causes a movement of the cutting element starting from an initial position of the cutting element in a direction pointing from the pouring opening to the inlet opening, so that the cutting element can be moved at least in sections through the inlet opening, and wherein the closure device has a tamper-evident device, wherein the tamper-evident device provides a first visible or tactile indication in a first state and provides a second visible or tactile indication in a second state which can be distinguished from the first indication.

Such closure devices are known from the prior art, in particular for the reclosable closure of beverage cartons, whereby these closure devices provide two convenience features which facilitate use by a customer, but also by a retailer.

On the one hand, the tamper-evident device signals whether the closure device has already been opened a first time or not.

On the other hand, the design of the closure device with a cutting device with a cutting element, mostly in the form of a cutting ring, and the closure cap with an entraining device enables the carton package to be forcibly pierced or cut and thus opened for the first time when it is opened for the first time. With a single movement, the user can thus open the carton package for the first time and simultaneously remove the closure cap from the basic member.

SUMMARY

Compared to such a known closure device, it is a task of the present invention to provide a closure device in which the closure cap remains attached to the basic member even after the initial opening, i.e. the separation of the closure cap from the basic member.

In addition, it is a task of the present invention to reliably ensure that before the container is pierced or cut by means of the cutting device, the tamper-evident device has changed from the first state to the second state, so that it is signalled that the closure device has already been at least partially opened.

The closure device according to the invention comprises a basic member, a closure cap with an entraining device, an anchor ring, a connecting element, a cutting element and a tamper-evident device.

The basic member has a channel extending along a closure axis with an inlet opening and a pouring opening. The basic member remains on the container even when the closure device is open and is firmly connected to it. In one embodiment, the basic member serves as a pouring spout for the container, whereby the fluid contained in the container can flow out of the container through the channel of the basic member.

According to the invention, the closure cap and the base member are designed and arranged relative to one another in such a way that the closure cap closes the pouring opening in a closed state of the closure device and releases it in an open state of the closure device, the closure cap being mounted on the base member in the closed state of the closure device such that it can rotate about the closure axis relative to the base member, so that the closure cap can rotate in an opening direction relative to the base member in order to bring the closure device into the open state.

In this regard, it is initially irrelevant for the present invention in principle in which manner the rotatability of the closure cap relative to the basic member is enabled.

In one embodiment of the invention, both the closure cap and the basic member may each have a thread, the threads interacting with each other so that the basic member and the closure cap form a screw cap. For example, the closure cap may have an internal thread and the basic member may have a corresponding external thread.

Another example of an embodiment of a closure cap that is rotatable relative to the basic member is a bayonet closure implemented by corresponding elements on the basic member and the closure cap. Such a bayonet closure allows the closure cap to be rotated relative to the basic member over a certain angular range before the closure cap is then separated from the basic member in the axial direction. The rotary movement of such a bayonet closure can either be realised in such a way that no axial movement of the closure cap relative to the basic member takes place during the rotary movement, or else an axial movement also takes place during the rotary movement.

According to the invention, the connecting element connects the anchor ring to the closure cap, whereby this connection remains in place even when the closure cap is separated from the base element, i.e. disengaged therefrom. In this way, captivity of the closure cap is ensured. For this purpose, the anchor ring is anchored to the basic member both in the closed state and in the open state of the closure device in such a way that the closure cap is connected to the basic member by the connecting element and the anchor ring even in the open state.

In this case, it is important to ensure that the closure cap can rotate relative to the basic member, although at the same time a connection of the closure cap via the connecting element to the anchor ring is provided both in the closed and in the open state. Therefore, according to the invention, the anchor ring is freely rotatable about the closure axis relative to the basic member over an angle of at least 180 degrees. In this way, when the closure cap is rotated relative to the basic member, the anchor ring rotates with the closure cap.

In one embodiment of the invention, the anchor ring is freely rotatable about the closure axis relative to the basic member through an angle of at least 300 degrees.

In one embodiment of the invention, the anchor ring is freely rotatable relative to the basic member through an angle of at least 350 degrees about the closure axis.

In one embodiment of the invention, the anchor ring is freely rotatable continuously about the closure axis relative to the basic member.

In one embodiment of the invention, the cutting device is a cutting ring having a substantially hollow cylindrical base shape, the hollow cylinder extending within the channel. In one embodiment, the cutting element is configured as a cutting tooth having at least one cutting edge or cutting tip. In one embodiment, the cutting ring comprises a plurality of cutting elements.

According to the invention, the entraining device of the closure cap and the cutting device are designed and arranged in such a way that a first rotation of the closure cap in the opening direction of rotation causes a movement of the cutting element starting from an initial position of the cutting element in a direction pointing from the pouring opening to the inlet opening, so that the cutting element can be moved at least in sections through the inlet opening. Thus, the entraining device, for example a bridge or a pin, which extends from a top plate of the closure cap into the channel of the basic member, drives the cutting device in such a way that it moves in the direction of the inlet opening and finally through it.

Since the basic member is seated on the carton package in the installed state, the cutting element pierces or cuts through the carton package when it passes through the inlet opening. In one embodiment, which also comprises a carton package, the carton package is pre-embossed in the region of engagement between the cutting element and the carton package and is thus weakened to enable easier piercing of the carton package with the aid of the cutting element.

According to the invention, the tamper-evident device is configured to provide a first visible or tactile indication in a first state and to provide a second visible or tactile indication different from the first indication in a second state. An example of such a tamper-evident device is a tearable bridge connecting two further elements of the closure device and made of the same material as the elements of the closure device. In this context, for the purposes of the present application, a line of weakness between two further elements which tears when the closure device is actuated for the first time is also considered to be such a bridge. For the purposes of the present application, a breaking of an element is also referred to as a rupture for linguistic simplification.

According to the invention, the closure device is further designed in such a way that, when the closure cap is first rotated in the direction of opening rotation, the tamper-evident device first changes from the first state to the second state at an angle of rotation D1, and only then, at an angle of rotation D2, does the cutting element move out of the channel through the inlet opening for the first time, so that the angle of rotation D2 is greater than the angle of rotation D1. Both rotation angles D1 and D2 are measured starting from the same rotation angle zero point D0.

By selecting the angles of rotation so that the angle of rotation D2 is greater than the angle of rotation D1, it is guaranteed that the tamper-evident device always first changes its state before the cutting element of the cutting device pierces the container.

In one embodiment of the invention, the rotation angle zero point D0 is determined by the angular position of the entraining device of the closure cap in the fully closed state of the closure device before it is opened for the first time. This angular position of the entraining element is predetermined by the position which the closure cap assumes after the closure device has been manufactured or assembled. This is also the position of the closure cap relative to the basic member after filling and after the carton package has been closed by the filler.

In one embodiment of the invention, the tamper-evident device comprises at least one tearable bridge, but more particularly a plurality of tearable bridges, between the anchor ring and the closure cap. This tearable bridge tears at the angle of rotation D1.

The tamper-evident devices of the prior art are based on the fact that a tamper-evident band, which is prevented from moving axially with respect to the neck of the container or the basic member of such a container, tears off the closure cap when it is opened for the first time. Since this tearing off also works with a closure for carton packages, the tamper-evident bands known from the prior art are furthermore prevented from a rotational movement with respect to the basic member or the neck of a container. Their rotational movement together with the closure cap is inhibited either immediately or after a few degrees, so that the tearable bridges between the TE band and the closure cap tear immediately when the closure cap is rotated.

If it is now provided in one embodiment of the invention that the tamper-evident device comprises a tearable bridge between the anchor ring and the closure cap, the tearing of the bridge can be caused exclusively by an axial movement of the closure cap relative to the basic member and thus relative to the anchor ring, since the anchor ring is freely rotatable relative to the basic member according to the invention (in particular because of the connecting element). Nevertheless, it must be ensured at the same time that the angle of rotation D2 at which the cutting element first moves out of the channel through the inlet opening must be greater than the angle of rotation D1 at which the tamper-evident device changes from its first state to its second state.

In the case of a tearable bridge between the anchor ring and the closure cap, the angle of rotation D1 at which the bridge tears will be significantly greater than a comparable angle of rotation D1 for a closure device with a tamper-evident band that is inhibited in its rotational movement. In the case of the freely rotating anchor ring, the tearing is caused essentially exclusively by axial forces, whereas in the case of a tamper-evident band inhibited in the rotational movement, the tearing is caused by shear forces and thus occurs significantly earlier.

In one embodiment of the invention, the basic member has an external thread and the closure cap has an internal thread corresponding to the external thread of the basic member. In one embodiment of the invention, a thread extends over a circumferential angle of 360 degrees or more, particularly preferably over 700 degrees or more. In particular, embodiments with a single thread extending over 360 degrees, with two threads both extending over 360 degrees or more, or with a single thread extending over 700 degrees or more, in particular over 720 degrees, are conceivable.

In one embodiment of the invention, the angle of rotation D2 is greater than the angle of rotation D1 by at least 5 degrees. In one embodiment of the invention, the angle of rotation D2 is at least 10 degrees greater than the angle of rotation D1. In one embodiment of the invention, the angle of rotation D2 is greater than the angle of rotation D1 by at least 20 degrees.

In one embodiment of the invention, the angle of rotation D1 is between 50 degrees and 150 degrees. In one embodiment of the invention, the angle of rotation D1 is between 70 degrees and 120 degrees. In one embodiment of the invention, the angle of rotation D1 is between 100 degrees and 110 degrees. Correspondingly large angles of rotation D1, i.e. angles of rotation of the closure cap when the tamper-evident device changes from its first state to its second state can only be ensured in the case of freely rotating anchor rings. They cannot be achieved with tamper-evident bands whose rotational movement is inhibited.

In one embodiment of the invention, the entraining device comprises an entraining element and the cutting device comprises a stop element, wherein the closure cap, the entraining device and the cutting device are constructed and arranged in such a manner that when the closure cap is first rotated in the opening direction of rotation, the entraining element is or comes into engagement with the stop element at an angle of rotation D3 of the closure cap, so that only a rotational movement of the closure cap in the opening direction of rotation which exceeds the angle of rotation D3 causes a movement of the cutting element in the direction of the inlet opening, the angle of rotation D3 being smaller than or equal to the angle of rotation D2.

Due to the delayed change of the tamper-evident device from its first to its second state, i.e. with a larger angle of rotation D1 than is the case with conventional tamper-evident tapes, the angle of rotation D2 at which the cutting element first moves out of the channel through the inlet opening must also be increased accordingly.

A delayed passage of the cutting element through the inlet opening at the angle of rotation D2 compared to conventional closures is provided in one embodiment of the invention by delaying the engagement between the entraining element and the stop element.

In one embodiment, the cutting element has an increased distance from the inlet opening and thus from the material of the container.

In another embodiment, a delayed engagement between the entraining element and the stop element is combined with an increased axial distance of the cutting edge or cutting tip of the cutting element from the inlet opening.

Therefore, in one embodiment of the invention, the angle of rotation D3 is greater than 0. In another embodiment, the angle of rotation D3 is at least 15 degrees. In a further embodiment, the angle of rotation D3 is at least 25 degrees. In one embodiment of the invention, the angle of rotation D3 is even at least 50 degrees and in a variant at least 70 degrees.

In one embodiment of the invention, the angle of rotation D3 is between 50 degrees and 150 degrees. In one embodiment of the invention, the angle of rotation D3 is between 70 degrees and 120 degrees. In one embodiment of the invention, the angle of rotation D3 is between 100 degrees and 110 degrees. In one of these embodiments, the delay in piercing or cutting the inlet opening with the cutting element can be implemented solely by a delayed engagement between the entraining element and the stop element.

In one embodiment of the invention, the angle of rotation D2 is greater than the angle of rotation D3 by at least 30 degrees. In one embodiment of the invention, the angle of rotation D2 is greater than the angle of rotation D3 by at least 50 degrees. In one embodiment of the invention of the invention, the angle of rotation D2 is greater than the angle of rotation D3 by at least 100 degrees. A correspondingly large delay between the engagement of the entraining element with the stop element and the first passage of the cutting element through the inlet opening takes account of the tamper-evident device possibly only transitioning from the first to the second state with a very long delay.

Alternatively, in one embodiment, the angle of rotation D2 is at most 30 degrees greater than the angle of rotation D3. In one embodiment of the invention, the angle of rotation D2 is at most degrees greater than the angle of rotation D3. In a further embodiment of the invention, the angle of rotation D2 is substantially 20 degrees greater than the angle of rotation D3. The resulting proximity of the angles of rotation D2 and D3 is particularly advantageous when the delay in the penetration of the cutting element through the inlet opening is caused at least partially or exclusively by the delayed engagement of the entraining element and the cutting element.

In a further embodiment of the present invention, the cutting element is arranged in its initial position at a distance of 1 mm or more from the inlet opening, measured parallel to the closure axis. In a further embodiment of the present invention, the cutting element is arranged in its initial position at a distance of 1.5 mm or more from the inlet opening, measured parallel to the closure axis. In a further embodiment of the present invention, the cutting element is arranged in its initial position at a distance, measured parallel to the closure axis, of 1.5 mm to 2 mm from the inlet opening. An axial distance or stroke of the cutting element between the initial position of the cutting element and the inlet opening corresponding to these embodiments provides sufficient delay in pushing the cutting element through the inlet opening and thus through the material of the container, even if the delay is provided exclusively by this distance or stroke.

If the delay is provided exclusively by the axial distance of the cutting element or its stroke, the angle of rotation D3 is even 0 degrees, i.e. the entraining element and the stop element are already in engagement with each other directly at the zero point of the angle of rotation DO.

In an alternative embodiment of the invention, the distance between the cutting element in its initial position and the inlet opening, measured parallel to the closure axis, is at most 0.5 mm. In a further embodiment of the invention, the distance between the cutting element in its initial position and the inlet opening, measured parallel to the closure axis, is at most 1 mm. This is particularly advantageous if the delay of the piercing of the cutting element through the inlet opening is caused at least partly or exclusively by the delayed engagement of the entraining element and the cutting element.

In a further embodiment, the angle of rotation D3 is greater than or equal to the angle of rotation D1. In one embodiment, the angle of rotation D3 is greater than the angle of rotation D1 by at least 15 degrees. In one embodiment, the angle of rotation D3 is greater than the angle of rotation D1 by at least 25 degrees.

In one embodiment of the invention, the cap comprises a top plate and a cap skirt extending circumferentially from the top plate. In a further embodiment of the invention, the connecting element and the anchor ring form an axial extension of the cap skirt in the direction of the inlet opening when the closure device is in the closed state. In one embodiment, the outer radius of the cap skirt then substantially coincides with the outer radius of the connecting element and the outer radius of the anchor ring.

In one embodiment of the invention, the connecting element is a connection band.

In one embodiment, in the closed state of the closure device, the connection band extends in the axial direction between the anchor ring and the cap skirt.

In one embodiment of the invention, the connection band has two longitudinal sides extending in the circumferential direction in the closed state of the closure device and two transverse sides extending substantially parallel to the axial direction of the channel. The connection band is connected to the closure cap on one of the two transverse sides and to the anchor ring on the other of the two transverse sides. In one embodiment, one of the two longitudinal sides is connected to the cap skirt of the closure cap via a tearable bridge, preferably via a plurality of tearable bridges, and the other longitudinal side is connected to the anchor ring via a tearable bridge, preferably via a plurality of tearable bridges.

In a further embodiment of the invention, the connecting element forms a hinge, in particular a foil hinge, so that the closure cap can be pivoted about a pivot axis relative to the anchor ring.

An advantage of an embodiment of the present invention over the prior art is that it makes it possible to provide a closure cap which is permanently connected to the basic member and thus to the container and which has a tamper-evident band, wherein an additional tamper-evident band in addition to the anchor ring required according to the invention can be dispensed with, so that the overall height of the closure is reduced compared to an embodiment having an additional tamper-evident band.

In one embodiment, the closure device therefore has no tamper-evident band, in particular no tamper-evident band whose rotational movement is inhibited relative to the basic member. In one such embodiment, the closure device has an extension measured along the closure axis of less than 17 mm when the cutting element is in its initial position. In another embodiment, this extension is less than 16 mm. In a further embodiment, this extension is less than 15 mm.

Nevertheless, embodiments are conceivable in which the tamper-evident device comprises an annular tamper-evident band, the tamper-evident band being connected to the anchor ring via at least one tearable bridge, the tamper-evident band being arranged on the side of the anchor ring facing away from the pouring opening. In one embodiment of the invention, the tamper-evident band and the basic member are configured such that a rotational movement of the tamper-evident band relative to the basic member is inhibited or blocked, so that the tamper-evident band can preferably undergo a rotational movement of max. 10 degrees relative to the basic member.

Furthermore, at least one of the aforementioned tasks is also solved by a carton package with a closure device in an embodiment as described above, wherein the carton package has a surface portion which can be cut with the cutting element and wherein the closure device is arranged in such a way that the cut surface portion bears against the inlet opening and covers the inlet opening before the closure cap is rotated for the first time in the opening direction of rotation.

BRIEF DESCRIPTION OF THE FIGURES

Further advantages, features and possible applications of the present invention will become clear from the following description of an embodiment and the accompanying figures. In the figures, the same elements are designated with the same reference signs.

DETAILED DESCRIPTION

Figure 1A:
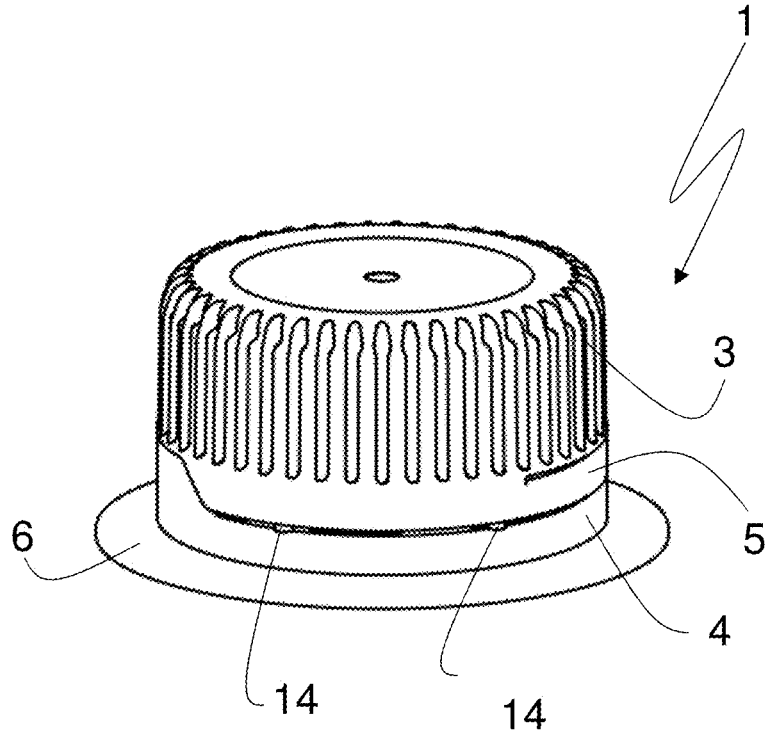
FIG. 1*a* is an isometric representation of a first embodiment of a closure device in an original, closed state.

The figures show two embodiments of a closure device 1 intended to be connected to a container in the form of a carton package.

In both embodiments, the closure device 1 comprises a basic member 2, a closure cap 3, a cutting device in the form of a cutting ring 18, an anchor ring 4 and a connecting element in the form of a connection band 5.

The closure devices 1 are intended to be connected to a container in the form of a carton pack. For this purpose, the basic member 2 has a circular-ring-shaped flange 6 which is connected to the outer surface of the carton package. From this flange 6, a hollow cylindrical section 7 of the basic member 2 extends substantially perpendicularly thereto. This hollow cylindrical section 7 is used for pouring liquid from the carton package (not shown in the figures). For this purpose, the hollow cylinder 7 defines a channel 9 extending along the closure axis 8. This channel 9 comprises an inlet opening 10 on its lower side facing the carton package and a pouring opening 11 on its side facing away from the carton package. The position of the inlet opening 10 is axially where the flange ring 6 of the basic member 2 extends.

The hollow cylindrical section 7 has an external thread 12. This external thread 12 interacts with an internal thread 13 of the closure cap 3. The closure cap 3 can therefore be unscrewed from and screwed back onto the hollow cylindrical section 7 of the basic member 2. In this way, the user can switch between an open state and a closed state of the closure device 1.

It is decisive for the following considerations that the closure device 3 remains connected to the basic member 2 by means of the connection band 5 and the anchor ring 4 even after the closure device 1 has been opened, i.e. after the closure device 3 has been disengaged from the basic member 2.

In the embodiments shown, tearable connecting webs 14 between the anchor ring 4 and the retaining band 5, but also between the retaining band 5 and the closure cap 3, serve as a tamper-evident device within the meaning of the present application. When the closure cap 3 is opened for the first time, i.e. when it is unscrewed, these bridges 14 tear and the broken or torn bridges 14 are visible to an observer. It can be seen whether the protective device 1 has already been opened a first time.

The anchor ring 4 therefore not only has the task of attaching the closure cap 2 to the basic member 2 even after it has been screwed on, but also of providing the necessary counterforces when the closure cap 2 is unscrewed for the first time, so that the bridges 14 tear or break.

To allow the closure cap 3 to be unscrewed from the basic member 2, i.e. to allow the closure cap 3 to be rotated relative to the basic member 2, the anchor ring 4 is fixed to the basic member 2 only in the axial direction, i.e. parallel to the closure axis 8. At the same time, the anchor ring 4 together with the closure cap 3 is freely rotatable relative to the basic member 2. In the embodiments shown, the anchor ring 4 is rotatable over a full 360 degrees and possibly a multiple thereof.

For axially fixing the anchor ring 4 relative to the basic member 2, the basic member 2 has on its outer wall a projection 16 extending in the shape of a circular ring on the outer wall. Latching lugs 17 extending radially inwards on the anchor ring 4 engage under this projection 16. These latching lugs 17 latch axially under the projection 16 of the basic member 2 when the closure cap 3 with the anchor ring 4 is first fitted to the basic member 2. The anchor ring 4 is thus held by the projection 16 in the axial direction parallel to the closure axis.

After the closure device 1 has been applied to the carton package, the carton package is completely closed, i.e. a section of the carton package extends beyond the inlet opening 10 of the channel 9 of the basic member 2. When the closure cap 3 is opened for the first time, the material of the carton package must be opened in the area of the inlet opening 10.

For this purpose, the closure device 1 has the cutting ring 18. This cutting ring 18 extends in the channel 9 of the basic member 2 and has a substantially hollow-cylindrical structure. The cutting ring 18 has four cutting elements in the form of sharpened cutting teeth 15.

The cutting ring 18 is configured to cooperate with a groove guide 20 provided in the inner wall surface 19 of the base element 2. The cutting ring 18 is guided on the inner wall surface 19 in such a way that it moves axially in the direction of the inlet opening 10 of the channel 9 when the closure cap is rotated for the first time relative to the basic member in the direction of opening rotation. During a rotational movement in the opening rotational direction, the cutting teeth 15 of the cutting ring 18 pass through the inlet opening 10 of the channel 9 at a point in time determined by the design. In the assembled state, in which the closure device 1 is applied to the carton package, the cutting teeth 15 cut through the carton package in the region of the inlet opening 10 of the channel 9 and open the package so that liquid from the carton package can flow into the channel 9 through the inlet opening 10.

For actuating the cutting ring 18, i.e. for unscrewing it towards and through the inlet opening of the channel 9, the closure cap 3 has an entraining device in the form of two entraining elements 21. These entraining elements 21 extend from the top plate 23 of the closure cap 3 in the axial direction into the channel 9. When the closure cap 3 is turned for the first time in the opening direction of rotation, the entraining elements 21 engage with complementary stop surfaces 22 of the cutting ring 18. Thus, a rotational movement of the closure cap 3 is transferred to a rotational movement of the cutting ring 18 when it is opened for the first time. In the axial direction, the closure cap 3 and the cutting ring 18 move in opposite directions. The entraining elements 21 and the stop surface 22 are in engagement with each other until the cutting ring 18 has reached a certain position in which the cutting teeth 20 extend maximally out of the inlet opening into the carton package.

In both embodiments of FIGS. 1*a* to 4, on the one hand, and of FIGS. 5*a* to 7*c*, on the other hand, the construction shown solves the technical problem that, simultaneously with a permanent connection of the closure cap 3 to the anchor ring 4, even in the opened state of the closure device 1, the tamper-evident device in the form of the bridges 14 reliably always changes from its intact first state to a broken second state before the cutting teeth 15 pass through the inlet opening 10 of the channel 9.

In other words, starting from a zero angle of rotation DO, the breaking of the bridges 14 must take place at an angle of rotation D1 and the passage of the cutting teeth 20 through the inlet opening 10 at an angle of rotation D2, the angle of rotation D1 being smaller than the angle of rotation D2.

This is complicated in that the anchor ring 4 is free to rotate without restriction relative to the base element 2. In this respect, tearing of the bridges 14 occurs exclusively due to the transmission of axial tensile forces of the closure cap 3 or of the bridge 5 to the bridges and not, for example, due to shear forces as in the case of a tamper-evident band whose rotational movement is also inhibited. To ensure this, in both embodiments of the closure device 1 the passage of the cutting teeth 15 through the inlet opening 10 of the channel 9 is delayed. This delay of the passage of the cutting teeth 15 through the inlet opening 9 is solved differently in the two embodiments according to FIGS. 1*a* to 4 on the one hand and 5*a* to 7*c* on the other hand.

In the figures, the figures numbered "a" show isometric views of the closure device 1. The drawings numbered "b" show the closure device 1 in a view from below, i.e. from the carton package. The figures numbered "c" are each cross-sectional views along the lines shown with the letters in the figures numbered "b".

Figure 1B:
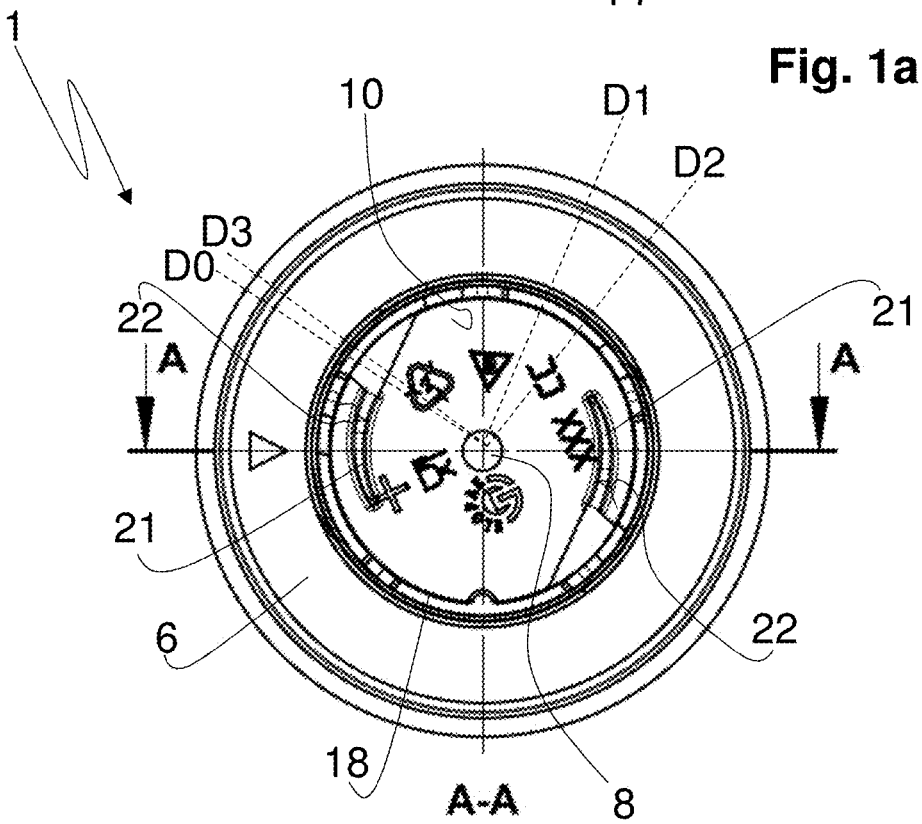
FIG. 1*b* is a view from below of the closure device according to the first embodiment in the state shown in FIG. 1*a*.
Figure 2A:
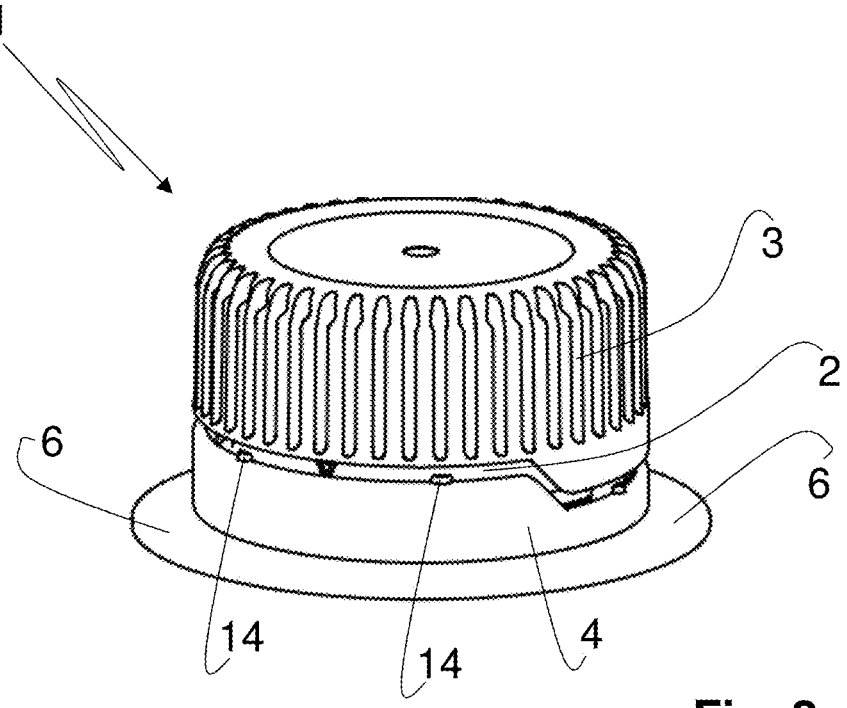
FIG. 2*a* is an isometric view of the first embodiment of the closure device in a state where the cutting element passes through the inlet opening.
Figure 2B:
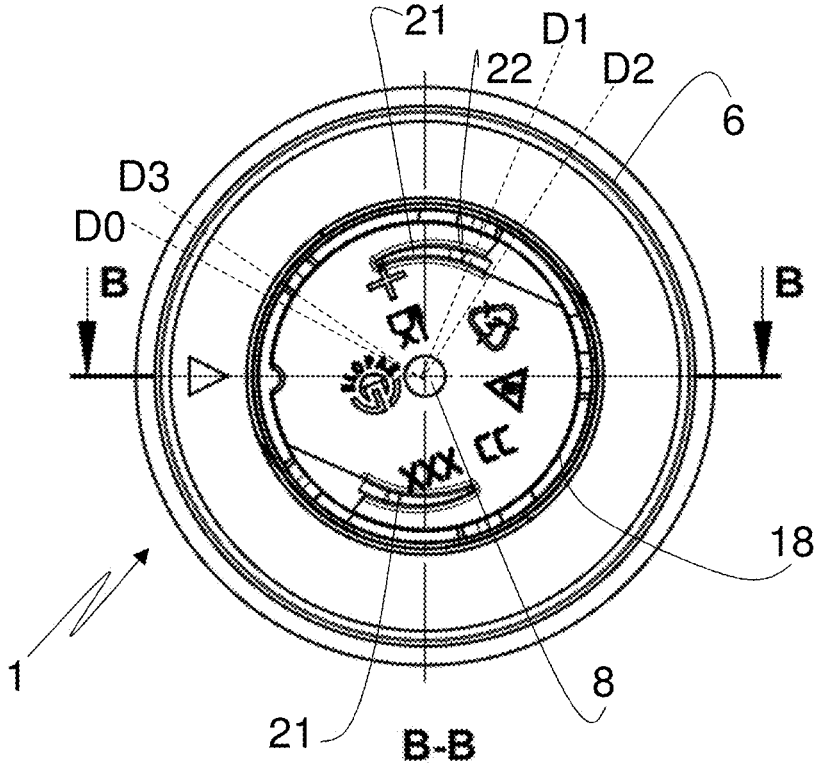
FIG. 2*b* is a bottom view of the closure device according to the first embodiment in the state shown in FIG. 2*a*.
Figure 3A:
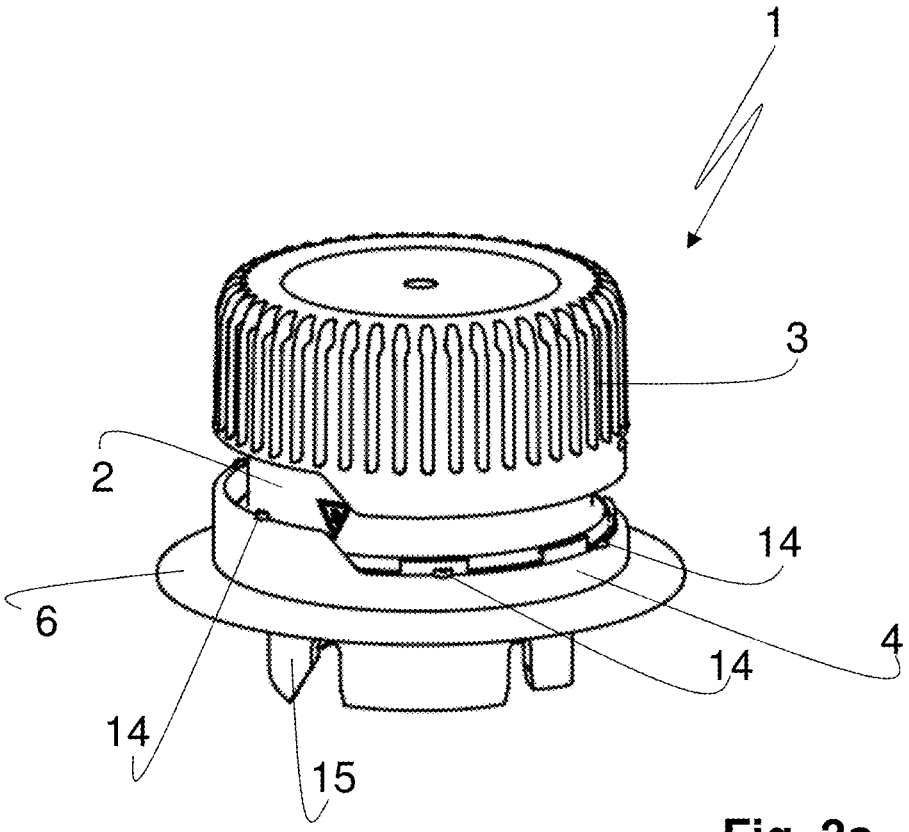
FIG. 3*a* is an isometric view of the first embodiment of the closure device in a condition where the cutting element has penetrated the inlet opening.
Figure 3B:
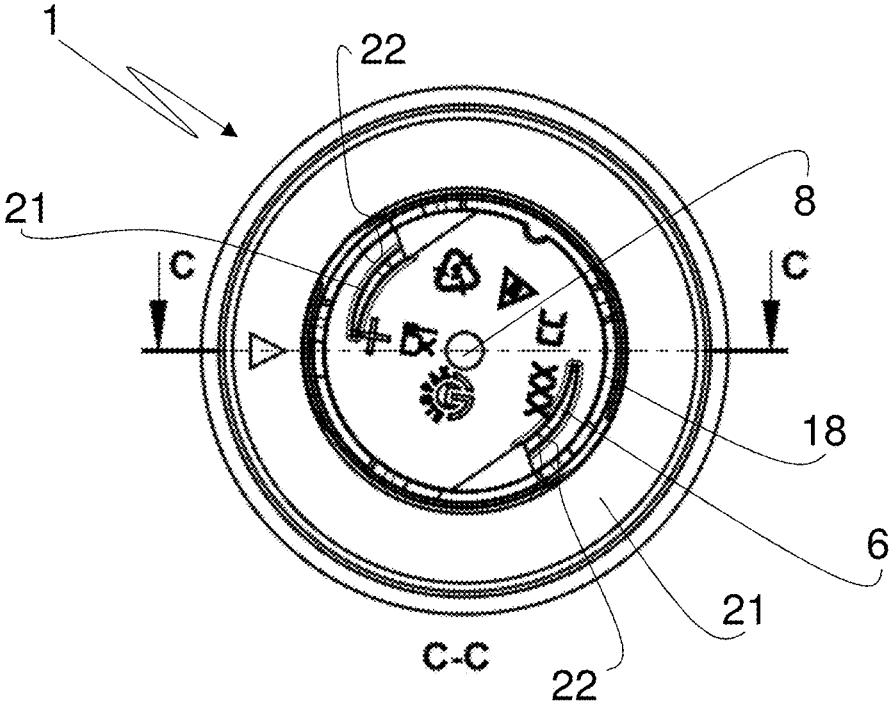
FIG. 3*b* is a bottom view of the closure device according to the first embodiment in the state shown in FIG. 3*a*.

In FIGS. 1*b*, 2*b*, 3*b* as well as 5*b*, 6*b*, 7*b* the respective angles of rotation which characterise the functionality of the closure devices shown are schematically drawn. The zero point of the angle of rotation D0 is given by the position of the entraining element 21 in the original, fully closed position of the closure devices before they are opened for the first time.

Figure 1C:
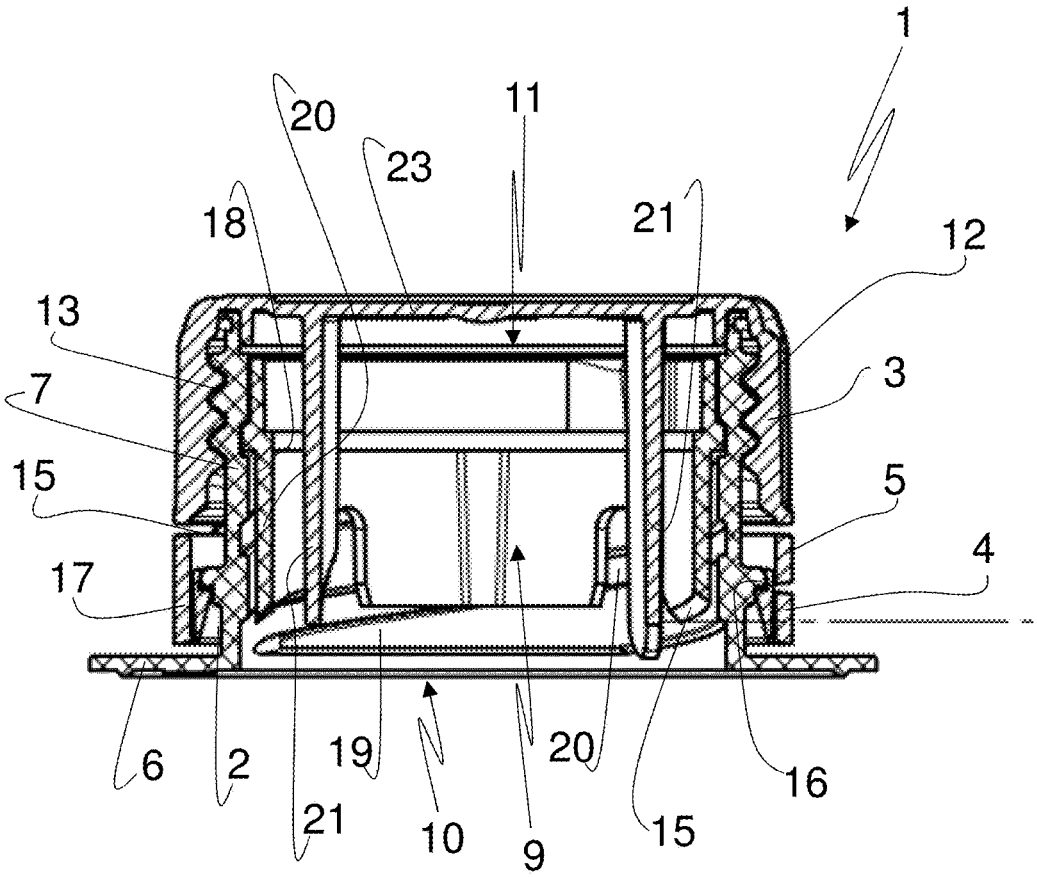
FIG. 1*c* is a cross-sectional view of the closure device of FIG. 1*b* along line A-A.

FIGS. 1*a* to 1*c* show the first embodiment of the closure device 1 in its original position as applied to the carton package, i.e. before the closure cap 3 is screwed on for the first time.

Figure 2C:
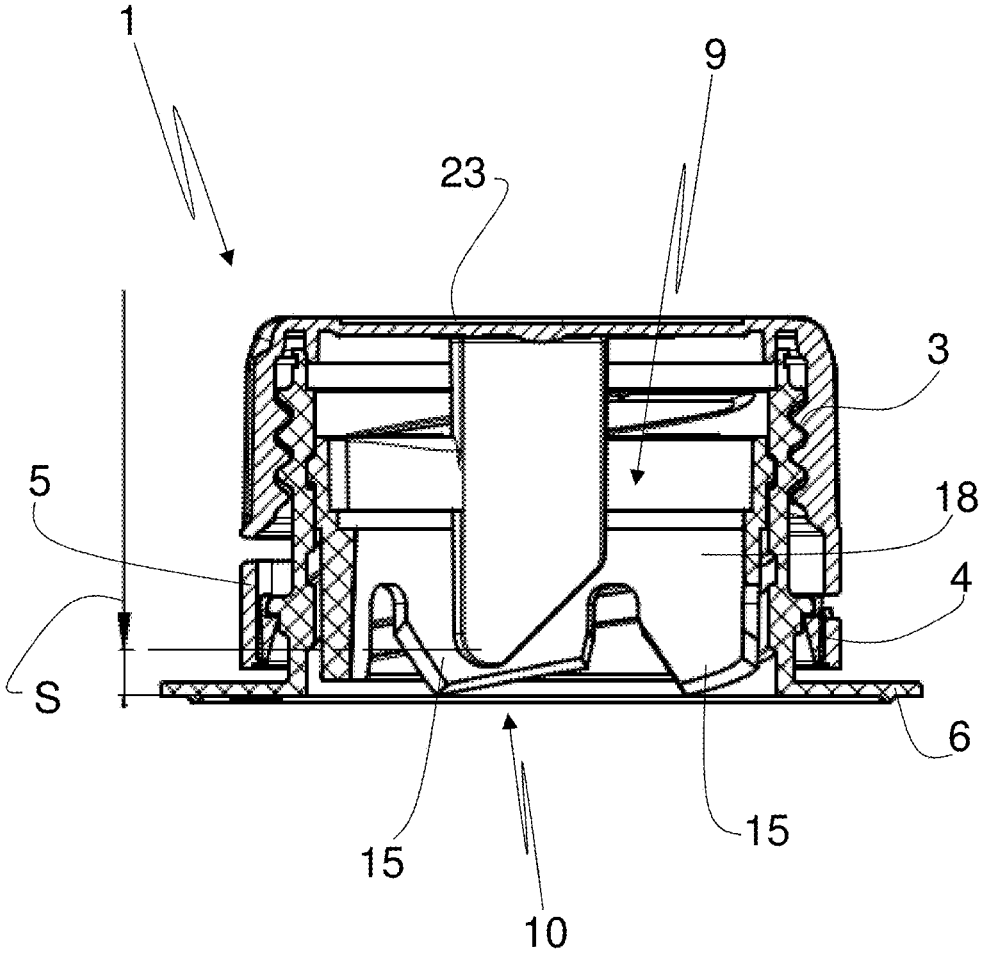
FIG. 2*c* is a cross-sectional view of the cap of FIG. 2*b* along the line B-B.

FIGS. 2*a* to 2*c* show the closure device 1 with the closure cap 3 having been rotated from the rotation angle zero point D0 to a rotation angle D2, wherein when the rotation angle D2 is reached the cutting teeth 15 extend into the inlet opening 10 of the channel 9.

It is understood that a breakaway or breaking of the bridges 14 thus occurs between the angles of rotation D1 shown in FIGS. 1*a* to 1*c* and 2*a* to 2*c*.

Figure 3C:
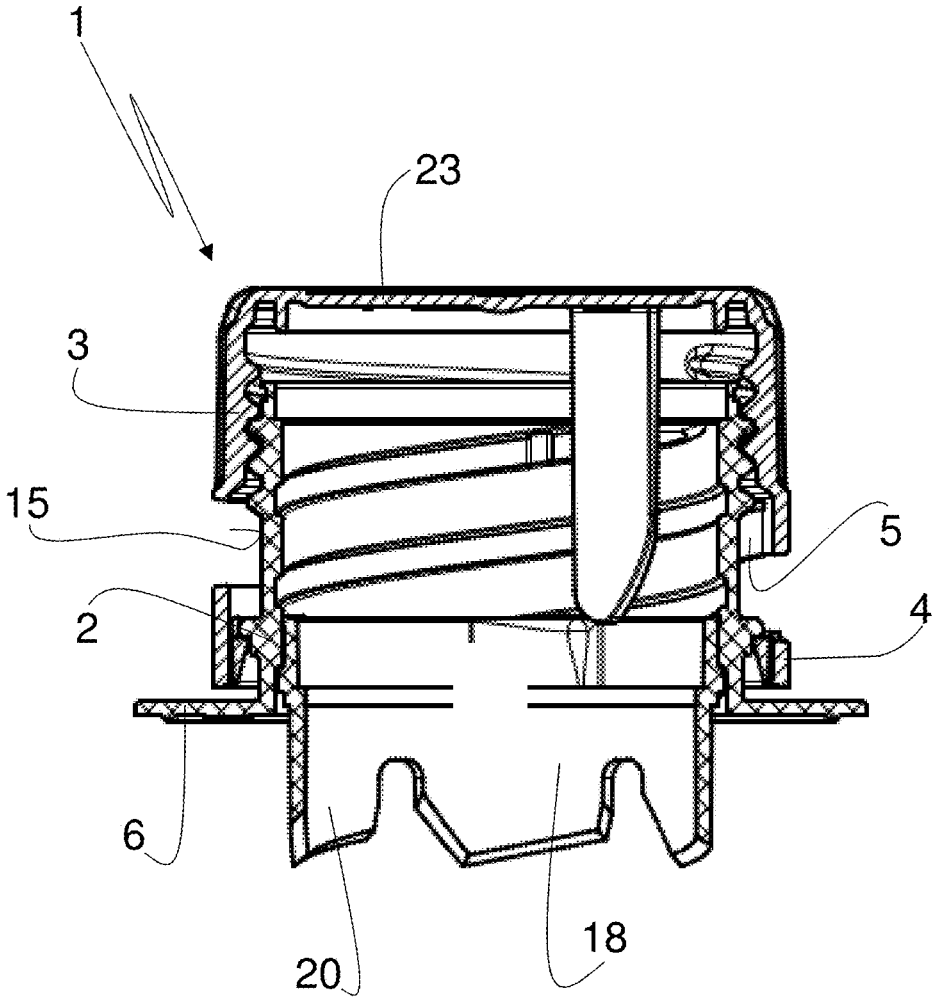
FIG. 3*c* is a cross-sectional view of the closure cap of FIG. 3*b* along the line C-C.

FIGS. 3*a* to 3*c* show a position of the closure device 1 in which the cutting teeth 15 of the cutting ring 18 protrude maximally from the inlet opening 10. In this position, the entraining elements 21 are again out of engagement with the stop surfaces 22 of the cutting ring 18.

In the embodiment of the closure device 1 as shown in FIGS. 1*a* to 4, the delay in the penetration of the cutting teeth 15 through the inlet opening 10 is effected by an increased axial distance of the cutting teeth 15 from the inlet opening 10. FIG. 2*c* shows with the dimension chain "s" the stroke, i.e. the axial distance that the cutting teeth 15 have to travel from their initial position, shown in FIGS. 1*a* to 1*c*, to penetrate the inlet opening 10, as shown in FIGS. 2*a* to 2*c*. Since in this embodiment the delay until the beginning of the cutting process, i.e. the engagement between the cutting teeth 15 and the cardboard packaging is exclusively caused by the increased stroke "s", the engagement between the stop surface 22 of the cutting ring 18 and the entraining element 21 can already begin at a very small angle of rotation D3. It is even possible that this engagement already occurs at a rotation angle D3 equal to zero, i.e. at the rotation angle zero point DO, or shortly thereafter.

Figure 4:
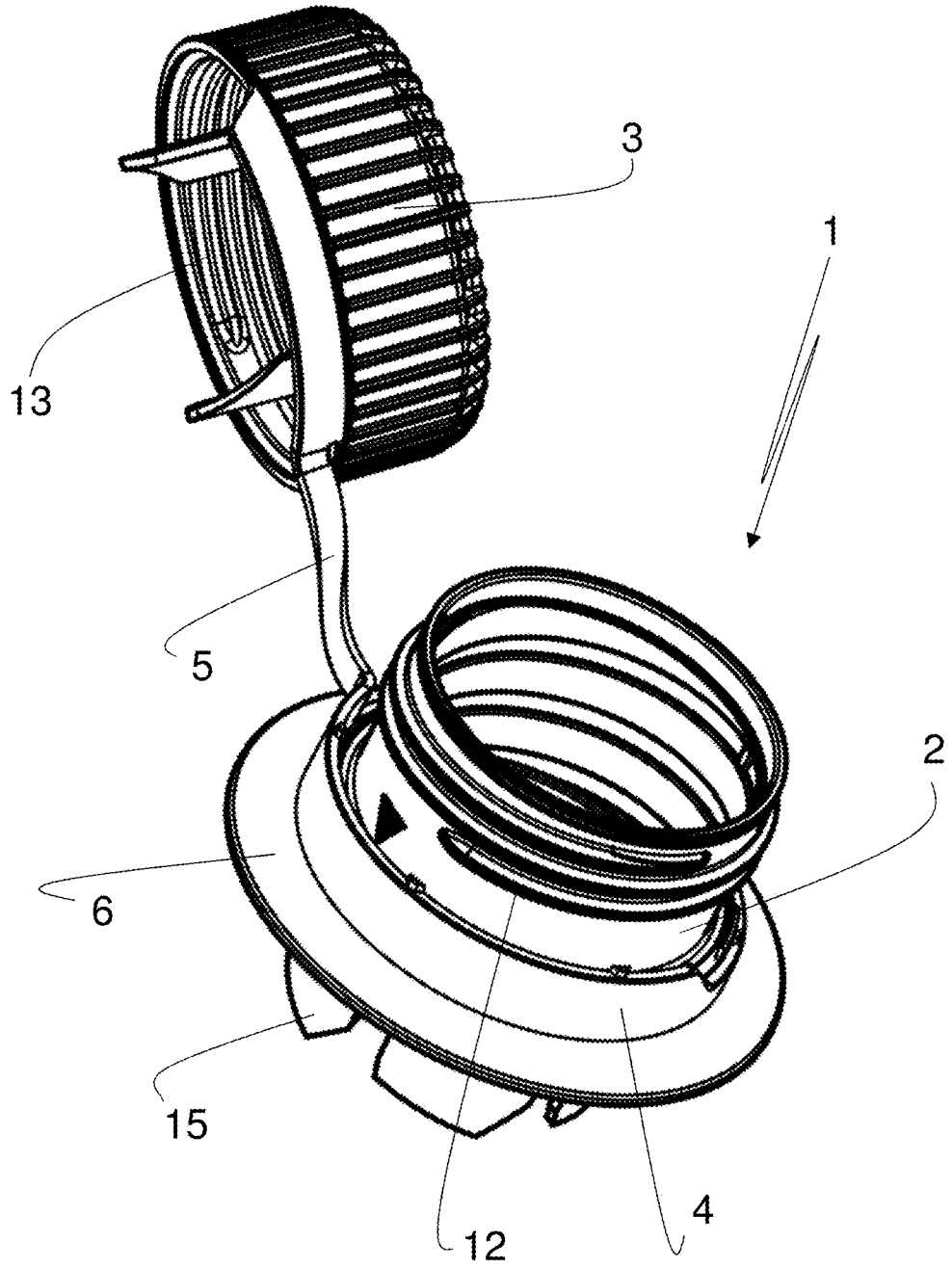
FIG. 4 is an isometric view of the closure device according to FIGS. 1*a* to 3*c* in the open state.
Figure 5A:
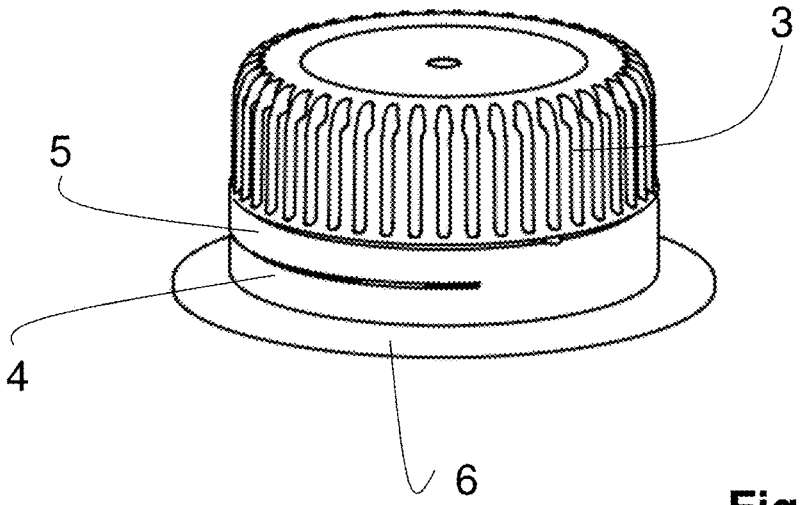
FIG. 5*a* is an isometric view of a second embodiment of a closure device in an original, closed state.
Figure 5B:
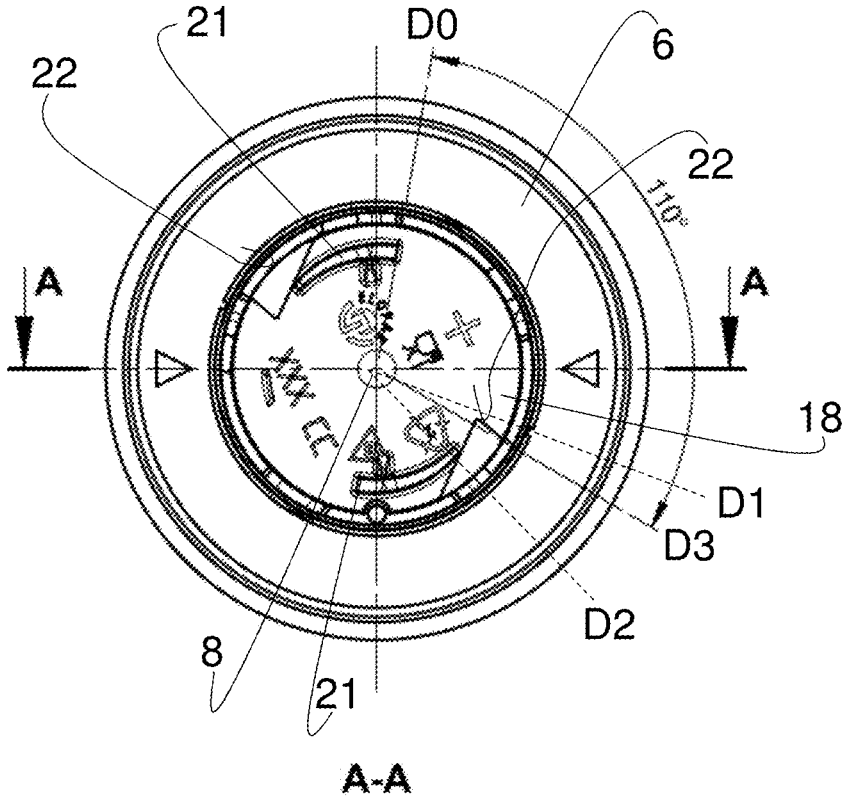
FIG. 5*b* is a bottom view of the closure device according to the second embodiment in the condition of FIG. 5*a*.
Figure 5C:
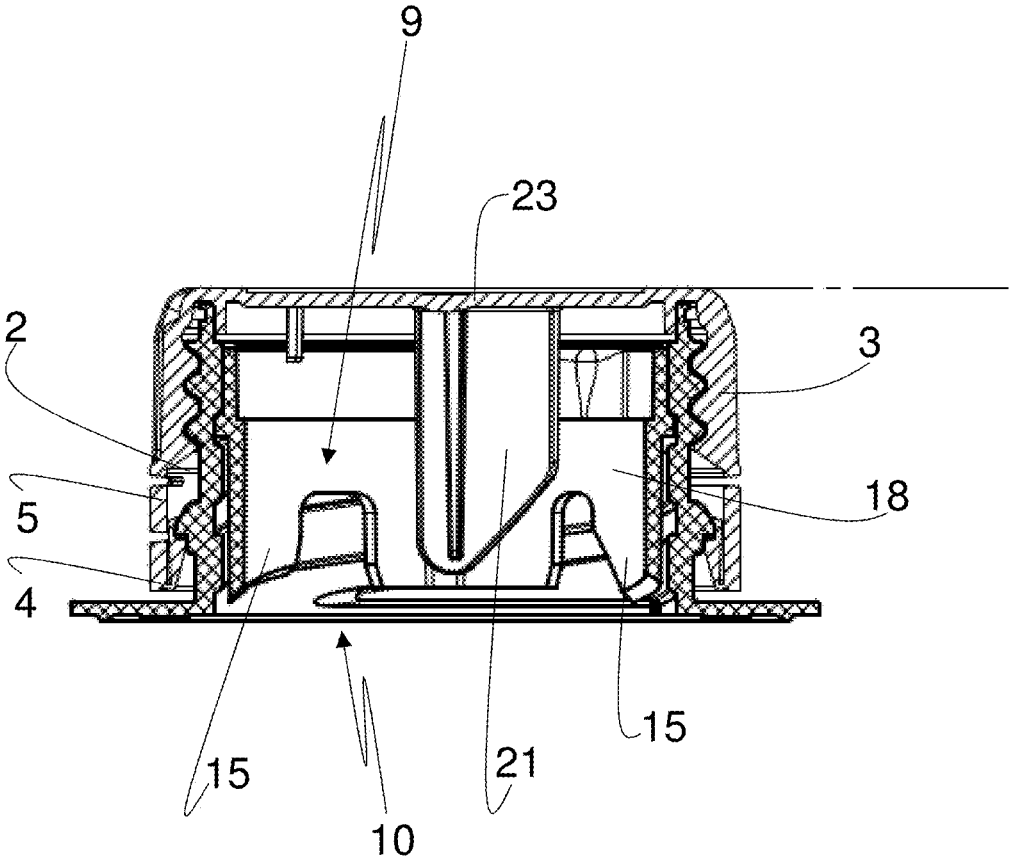
FIG. 5*c* is a cross-sectional view of the cap of FIG. 5*b* along line A-A.

In contrast, the stroke s' that the cutting teeth cover between their starting position of FIGS. 5*a* to 5*c* and the piercing of the carton package is significantly smaller than the stroke s in the first embodiment according to FIGS. 1*a* to 4.

FIGS. 5*a* to 5*c* show the second embodiment of the closure device 1 in its original position as applied to the carton package, i.e. before the closure cap 3 is screwed on for the first time.

Figure 6A:
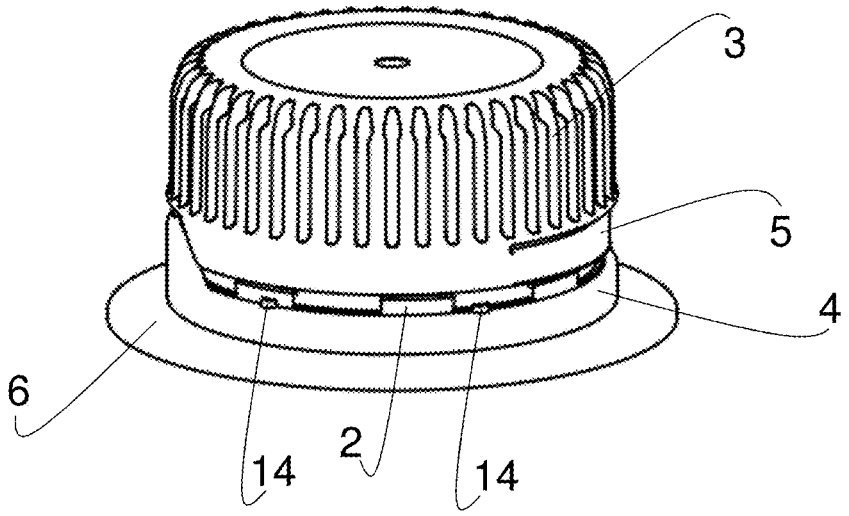
FIG. 6*a* is an isometric view of the second embodiment of the closure device in a condition in which the entraining element of the closure cap engages the stop surface of the cutting device.
Figure 6B:
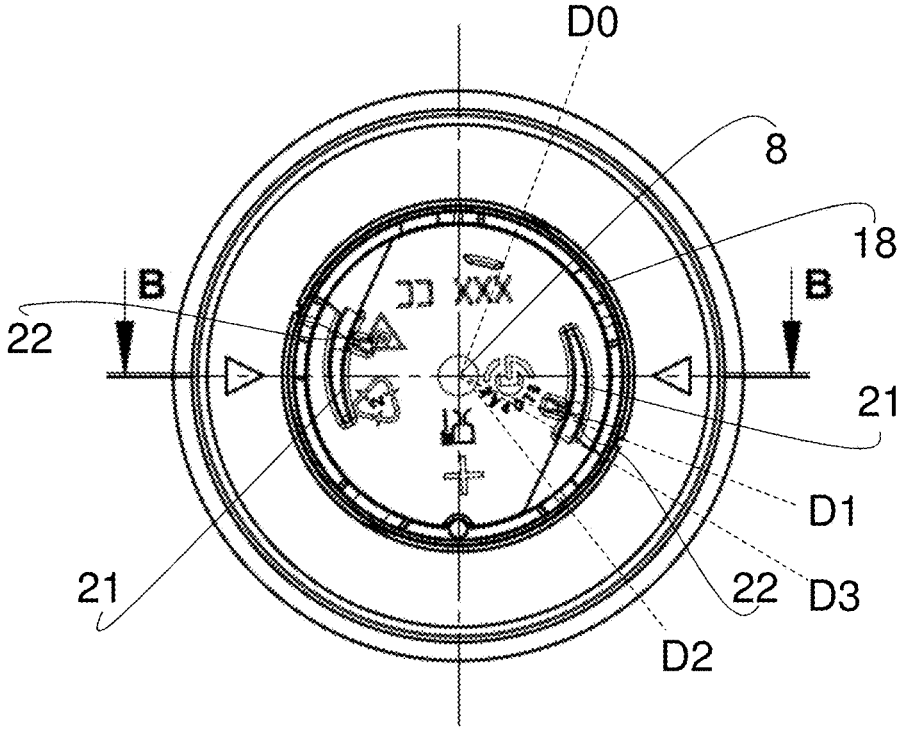
FIG. 6*b* is a bottom view of the closure device according to the second embodiment in the state shown in FIG. 6*a*.
Figure 6C:
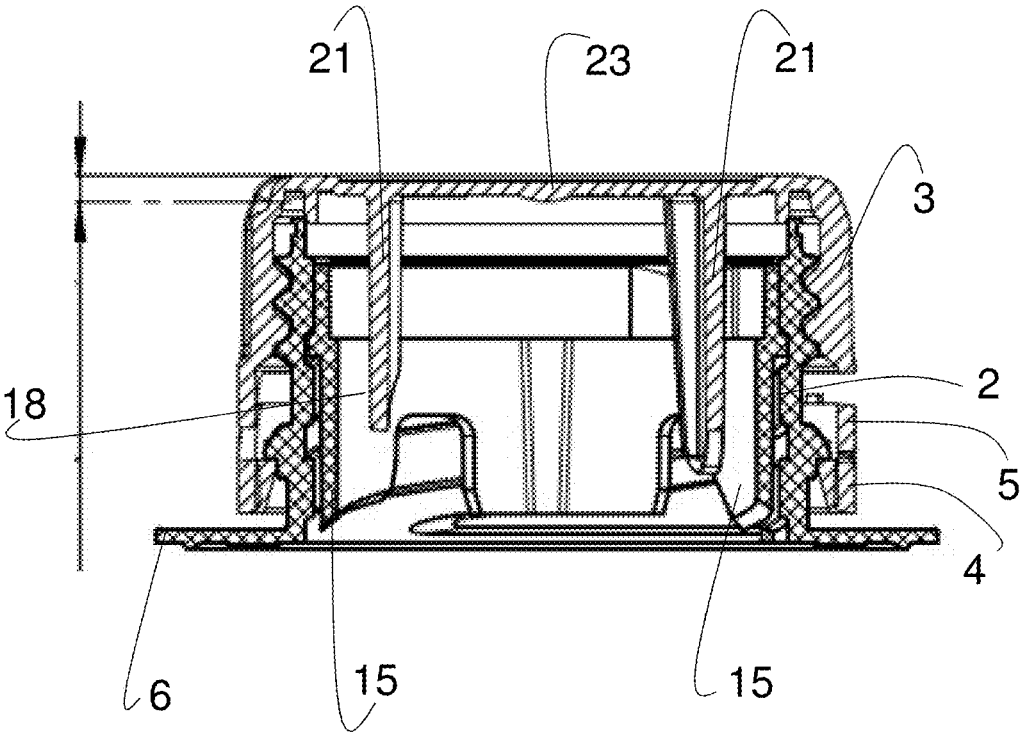
FIG. 6*c* is a cross-sectional view of the closure cap of FIG. 6*b* along the line B-B.

The fact that a delay in piercing the carton package is nevertheless achieved is due to a delayed engagement between the stop surfaces 22 of the cutting ring 18 and the entraining elements 21 of the closure cap 3 at the angle of rotation D3. FIGS. 6*a* to 6*c* show the closure device 1 when this angle of rotation D3 is reached, starting from the zero angle of rotation position DO.

Figure 7A:
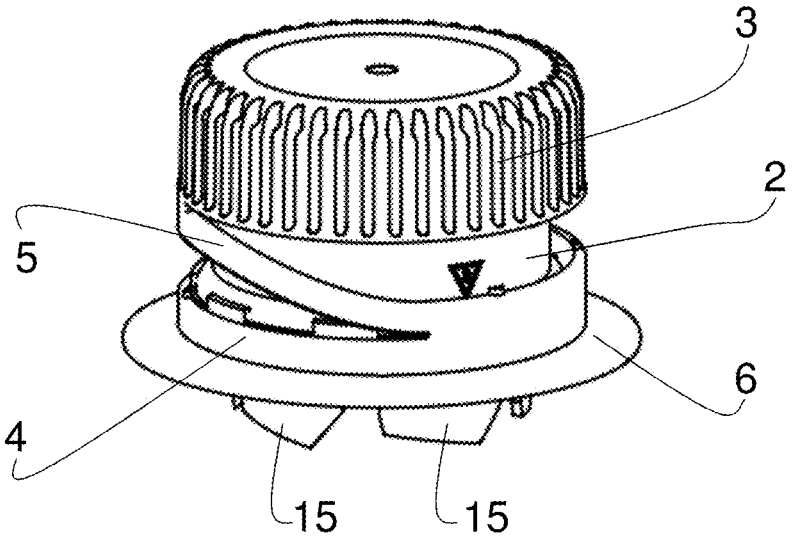
FIG. 7*a* is an isometric view of the second embodiment of the closure device in a condition where the cutting element has completely penetrated the inlet opening.
Figure 7B:
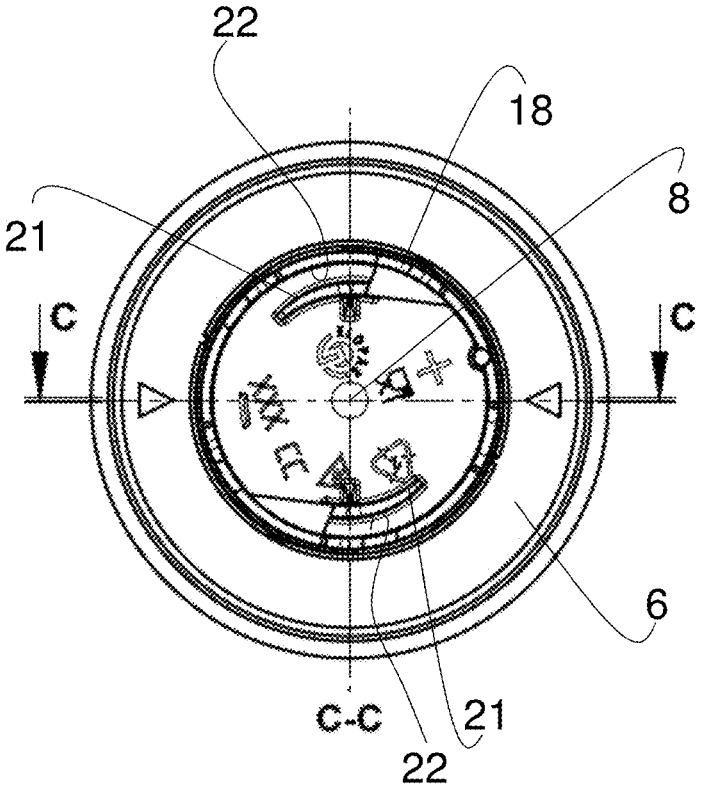
FIG. 7*b* is a bottom view of the closure device according to the second embodiment in the state shown in FIG. 7*a*.
Figure 7C:
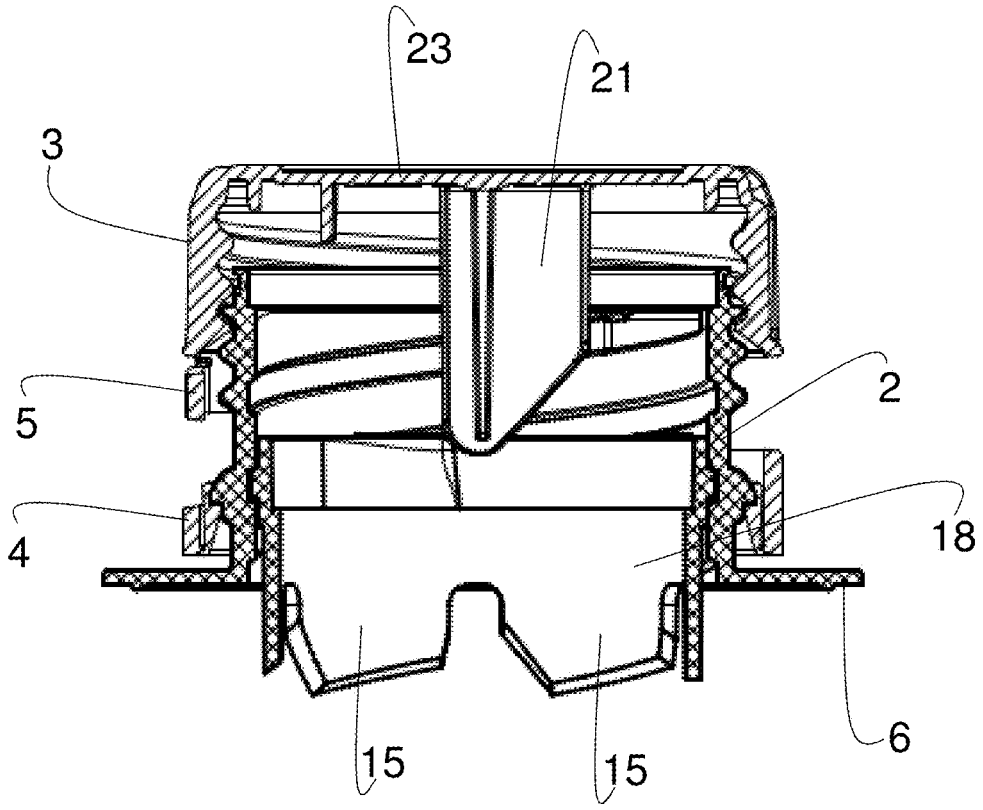
FIG. 7*c* is a cross-sectional view of the closure device of FIG. 7*b* along the line C-C.

FIGS. 7*a* to 7*c* show a position of the closure device 1 in which the cutting teeth 15 of the cutting ring 18 protrude maximally from the inlet opening 10. In this position, the entraining elements 21 can again be out of engagement with the stop surfaces 22 of the cutting ring 18.

The opened closure according to the second embodiment does not differ from the representation in FIG. 4.

A state of the closure in which the closure cap has reached the angle of rotation D2 at which the cutting teeth 15 penetrate the inlet opening 10 is not shown for this second embodiment.

It is understood that tearing or breaking of the bridges 14 also occurs in this second embodiment at the angle of rotation D1 before the angle of rotation D2.

While FIGS. 1*a* to 4 on the one hand and FIGS. 5*a* to 7*c* on the other hand show two different realisations of the delay, mixed forms are also conceivable in which the engagement is delayed at the angle of rotation D3 and at the same time the stroke of the cutting teeth is also increased.

For the purposes of the original disclosure, it is pointed out that all features or embodiments as they become apparent to a person skilled in the art from the present description, the drawings and the claims, even if they have been specifically described only in connection with certain further features, can be combined both individually and in any combination with other features or groups of features disclosed herein, unless this has been expressly excluded or technical circumstances render such combinations impossible or pointless. For the sake of brevity and readability of the description, no comprehensive, explicit description of all conceivable combinations of features is given here.

While the invention has been illustrated and described in detail in the drawings and the foregoing description, this illustration and description are merely illustrative and are not intended to limit the scope of protection as defined by the claims. The invention is not limited to the disclosed embodiments.

Variations of the disclosed embodiments are obvious to the skilled person from the drawings, the description and the appended claims. In the claims, the word "comprising" does not exclude other elements or steps, and the indefinite article "one" or "a" does not exclude a plurality. The mere fact that certain features are claimed in different claims does not exclude their combination. Reference signs in the claims are not intended to limit the scope of protection.

REFERENCE SIGNS

1 Closure device
2 Basic member
3 Closure cap
4 anchor ring
5 Connection band
6 flange
7 hollow cylindrical section
8 Closure axis
9 channel
10 inlet opening
11 pouring opening
12 external thread
13 Internal thread
14 Connecting band
15 Cutting tooth
16 Projection
17 Locking lug
18 Cutting ring
19 Inner wall surface
20 Groove guide
21 Entraining element
22 Stop face
23 Head plate
D0 zero angle of rotation
D1 first angle of rotation
D2 second angle of rotation
D3 third angle of rotation
s, s' stroke

The invention claimed is:

1. A closure device for closing a container, comprising:

a basic member, the basic member having a channel extending along a closure axis with an inlet opening and a pouring opening, wherein the closure device comprises a closure cap, wherein the closure cap and the basic member are formed and arranged relative to each other such that the closure cap closes the pouring opening in a closed state of the closure device and opens it in an open state of the closure device, wherein the closure cap is rotatably mounted on the basic member about the closure axis in the closed state of the closure device relative to the basic member so that the closure cap is rotatable in an opening direction of rotation relative to the basic member in order to bring the closure device into the open state, wherein the closure device comprises an anchor ring and a connecting element, wherein the connecting element connects the anchor ring to the closure cap, wherein the anchor ring is engaged with the basic member both in the closed state and in the open state of the closure device such that the closure cap is connected to the basic member with the connecting element and the anchor ring also in the open state, wherein the anchor ring is freely rotatable relative to the basic member over an angle of at least 180 degrees about the closure axis, wherein the closure device comprises a cutting device arranged at least in sections within the channel and having a cutting element, and wherein the closure cap comprises an entraining device, wherein the entraining device and the cutting device are formed and arranged in such a way that a first rotation of the closure cap in the opening direction of rotation causes a movement of the cutting element starting from an initial position of the cutting element in a direction pointing from the pouring opening to the inlet opening, so that the cutting element can be moved at least in sections through the inlet opening, wherein the closure device has a tamper-evident device, wherein the tamper-evident device in a first state provides a first visible or tactile indication and in a second state provides a second visible or tactile indication to be distinguished from the first indication, the closure device being designed in such a way that, when the closure cap is rotated for the first time in the opening direction of rotation, the tamper-evident device first changes from the first state to the second state at an angle of rotation D1 and then, at an angle of rotation D2, the cutting element moves out of the channel for the first time through the inlet opening, so that the angle of rotation D2 is greater than the angle of rotation DI, wherein both angles of rotation D1 and D2 are measured starting from the same angle of rotation zero point DO.

2. The closure device according to claim 1, wherein the tamper-evident device comprises a tearable bridge between the anchor ring and the closure cap, wherein the tearable bridge tears at the angle of rotation D1.

3. The closure device according to claim 1, wherein the basic member has an external thread and the closure cap has an internal thread corresponding to the external thread of the basic member, wherein a thread extends over a circumferential angle of 360 degrees or more.

4. The closure device according to claim 1, wherein the angle of rotation D2 is greater than the angle of rotation D1 by at least 5 degrees.

5. The closure device according to claim 1, wherein the angle of rotation D1 is between 50 and 150 degrees.

6. The closure device according to claim 1, wherein the entraining device comprises an entraining element, wherein the cutting device comprises a stop element, the closure cap, the entraining device and the cutting device being designed and arranged in such a way that, when the closure cap is rotated for the first time in the opening direction of rotation, the entraining element engages with the stop element at an angle of rotation D3 of the closure cap, so that only a rotational movement of the closure cap in the opening rotational direction exceeding the rotational angle D3 causes a movement of the cutting element in the direction of the inlet opening, the rotational angle D3 being smaller than the rotational angle D2, the angle of rotation D3 being measured from the zero point of rotation DO.

7. The closure device according to claim 6, wherein the angle of rotation D3 is greater than zero.

8. The closure device according to claim 7, wherein the angle of rotation D3 is between 50 degrees and 150 degrees.

9. The closure device according to claim 6, wherein the angle of rotation D2 is at most 30 degrees greater than the angle of rotation D3.

10. The closure device according to claim 6, wherein the angle of rotation D2 is greater than the angle of rotation D3 by at least 30 degrees.

11. The closure device according to claim 1, wherein the cutting element, in its initial position, is arranged at a distance, measured parallel to the closure axis, of 1 mm or more.

12. The closure device according to claim 1, wherein the connecting element is a connection band.

13. The closure device according to claim 1, wherein the connecting element forms a hinge such that the closure cap is pivotable about a pivot axis relative to the anchor ring.

14. The closure device according to claim 1, wherein the tamper-evident device comprises an annular tamper-evident band, wherein the tamper-evident band is connected to the anchor ring via at least one tearable bridge, the tamper-evident band being arranged on the side of the anchor ring facing away from the pouring opening.

15. The closure device according to claim 1, wherein the closure cap comprises a top plate and a circumferentially extending cap skirt, wherein the connecting element and the anchor ring form an axial extension of the cap skirt in the direction of the inlet opening in the closed state of the closure device, such that the outer radius of the cap skirt coincides with the outer radius of the connecting element and the outer radius of the anchor ring.

16. A carton package comprising the closure device according to claim 1, wherein the carton package has a surface portion which can be cut by the cutting element, and wherein the closure device is arranged such that the cuttable surface portion abuts the inlet opening and covers the inlet opening prior to the first rotation of the closure cap in the opening rotation direction.

* * * * *